United States Patent [19]

Hebsur et al.

[11] Patent Number: 4,983,358

[45] Date of Patent: Jan. 8, 1991

[54] NIOBIUM-ALUMINUM BASE ALLOYS HAVING IMPROVED, HIGH TEMPERATURE OXIDATION RESISTANCE

[75] Inventors: Mohan G. Hebsur, North Olmsted; Joseph R. Stephens, Berea, both of Ohio

[73] Assignee: Sverdrup Technology, Inc., Tullahoma, Tenn.

[21] Appl. No.: 406,700

[22] Filed: Sep. 13, 1989

[51] Int. Cl.[5] ..... C22C 27/00; C22C 21/04

[52] U.S. Cl. ..... 420/425; 420/588; 148/407

[58] Field of Search ..... 420/425, 588; 148/407

[56] References Cited

U.S. PATENT DOCUMENTS

| | | | |
|---|---|---|---|
| 2,838,396 | 6/1958 | Rhodin, Jr. | 420/425 |
| 2,883,282 | 4/1959 | Wainer | 420/425 |
| 3,028,236 | 4/1962 | Wlodek | 420/425 |
| 3,168,380 | 2/1965 | Bradley | 420/425 |
| 3,346,379 | 10/1967 | Rhodin, Jr. | 420/425 |
| 3,805,119 | 4/1979 | Koch et al. | 420/425 |
| 3,887,364 | 6/1975 | Kawabe et al. | 420/425 |
| 4,108,645 | 8/1978 | Mitchell et al. | 420/425 |

OTHER PUBLICATIONS

Svedberg-Oxides Associated with the Improved Air Oxidation Performance of some Niobium Intermetallics and Alloys-pp. 330-361.

Perkins and Chiang-Formation of Alumina on N6-A1 Alloys-Scripta Metallurgica-vol. 22, -pp. 419-424, (1988).

Hebsur and Locci-Microstructures in Rapidly Solidified Niobium Aluminides-NASA Technical Memorandum 100264-pp. 1-16, (1988).

*Primary Examiner*—Upendra Roy

*Attorney, Agent, or Firm*—Watts, Hoffmann, Fisher & Heinke

[57] ABSTRACT

A niobium-aluminum base alloy having improved oxidation resistance at high temperatures and consisting essentially of 48%-52% niobium, 36%-42% aluminum, 4%-10% chromium, 0%-2%, more preferably 1%-2%, silicon and/or tungsten with tungsten being preferred, and 0.1%-2.0% of a rare earth selected from the group consisting of yttrium, ytterbium and erbium. Parabolic oxidation rates, $k_p$, at 1200° C. range from about 0.006 to 0.032 $(mg/cm^2)^2/hr$. The new alloys also exhibit excellent cyclic oxidation resistance.

5 Claims, 4 Drawing Sheets

NIOBIUM-ALUMINUM BASE ALLOYS HAVING IMPROVED, HIGH TEMPERATURE OXIDATION RESISTANCE

The invention described herein was made in the performance of work under NASA Contract No. NAS324105, and is subject to the provisions of Section 305 of the National Aeronautics and Space Act of 1958, as amended (42 U.S.C. 2457).

TECHNICAL FIELD

The present invention relates generally to niobium-aluminum base alloys suitable for use in high temperature applications, such as advanced gas turbine engines and the like, and more specifically to improved niobium-aluminum-chromium alloys characterized by excellent high temperature oxidation resistance.

BACKGROUND

Gas turbine engines, turbine parts and the like which operate at high temperatures well above 650° C., for example, 1100°-1600° C., require materials exhibiting unusual oxidation resistance and good strength. At the present time, nickel-base superalloys are the most widely used materials in aircraft engines, since they can withstand temperatures up to 1100° C. In order to extend the use temperature to 1600° C. or higher, increase efficiency, and reduce fuel costs, advanced ceramics and refractory metals have been considered. New materials such as ceramic matrix composites show some potential in terms of thermal capability and strength/-weight ratio; however, they also present high risks in terms of reliability. Refractory metals or intermetallic compounds offer another possibility for high temperature matrix materials.

In particular, niobium and niobium alloys among the refractory metals have been considered for use because of their favorable combination of density, high melting temperature, cost and availability. However, niobium-base alloys oxidize very rapidly above 650° C. Also, they are embrittled by oxygen, carbon and nitrogen. While niobium alloys can be coated with an oxidation resistant silicide, such as $MoSi_2$, coating performance and reliability are not satisfactory for advanced gas turbines which are required to have extended lives at high temperatures.

The oxidation behavior of niobium base alloys has been the subject of considerable research in the past. It has been shown that the slowest oxidation rate of all niobium-aluminum compounds was observed for $NbA_3$. The parabolic oxidation constant, $k_p$, was found to be two orders of magnitude higher than that of NiAl which forms a protective aluminum scale at 1200° C. An alumina inner layer is formed on $NbAl_3$ adjacent to the metal-oxide interface while an NbAlO4 outer layer is formed at the oxide-gas interface. More recent work has shown the feasibility of forming compact, adherent alumina scales on niobium-aluminum alloys at greatly reduced aluminum contents, but at and above 1400° C. These modified alloys have included additions of titanium to increase the solubility and diffusivity of aluminum, and chromium and/or vanadium to decrease the solubility-diffusivity product of elemental oxygen in the alloy.

U.S. Pat. No. 2,838,396 discloses modified niobium-aluminum-chromium alloys asserted to have high strength and oxidation resistance at temperatures ranging from 1000–1300° C. and higher. The disclosed alloys have a reduced aluminum content of 1–20%, and include chromium in a range 1–30%. In addition to chromium, the alloys optionally include one or more of the elements cobalt, nickel, tungsten and zirconium, from 1–5% by weight of one or more of the elements beryllium, manganese, silicon, thorium and vanadium, and 0–2% by weight of one or more of the elements boron, carbon, calcium and cerium to impart certain desired characteristics, such as the properties of protective oxide scale or a special metallurgical response to heat treatment or fabrication, etc.

BRIEF DESCRIPTION OF THE INVENTION

An object of this invention is to provide a new niobium-aluminum base alloy composition which exhibits good strength and excellent oxidation resistance at elevated temperatures up to 1400° C. and higher. A more particular object is to provide a high aluminum content, and hence low density, niobium-aluminum base alloy characterized in part by its alumina-forming capability and consequent greatly improved oxidation resistance. Still another object of this invention is to provide an improved niobium-aluminum base alloy characterized in part by a high melting point of about 1685 C or higher, a high aluminum content with a resulting low density of about 4.5 $gm/cm^3$, excellent high temperature oxidation resistance evidenced by a low parabolic oxidation constant and low specific weight gain under cyclic heating conditions, good strength, and thermal expansion characteristics at least as good as $NbAl_3$.

The combined properties of a new alloy of this invention provide special potential for advanced aerospace applications. One such application is for the matrix of fiber reinforced composites used to make turbine blades. Another application is a coating for niobium in rocket nozzles.

These and other objects are realized by a niobium-aluminum base alloy composition consisting essentially in amounts by weight of about 48–52% niobium, 36–42% aluminum, 4–10% chromium, 0–2%, more preferably 1–2%, silicon and/or tungsten, and 0.1–2.0% of a rare earth selected from the group consisting of yttrium, ytterbium and erbium. Of the two elements silicon and tungsten, tungsten is preferred.

The ternary addition of chromium to $NbAl_3$ has been found most effective in favoring the selective oxidation of aluminum so as to form exclusive layers of alumina on the metal interface. The further addition of one of the rare earth elements yttrium, ytterbium and erbium has been found to result in nearly an order of magnitude decrease in the parabolic oxidation constant $k_p$ at 1200° C. At the same time, the three rare earths yttrium, ytterbium and erbium have been specifically found effective in promoting excellent cyclic oxidation resistance. Niobium-aluminum-chromium alloys containing one of these three rare earths have been shown to have a cyclic oxidation resistance for 100 hours at 1200° C. which is nearly equivalent to nickel-aluminum alloys with a zircon addition.

A further improvement in the oxidation resistance is achieved by the addition of silicon and/or tungsten, more preferably tungsten alone. For example, a $k_p$ value of 0.012 $mg^2/cm^4/hr$ was achieved with a 50% niobium, 40% aluminum, 8% chromium, 1% ytterbium and 1% silicon alloy. This is the same as that of the best nickel-aluminum plus zirconium alloys. A still lower $k_p$ value of 0.006 $mg^2/cm^4/hr$ is achieved by a 50% niobium, 40% aluminum, 8% chromium, 1% yttrium and 1% tungsten alloy.

BEST MODES OF CARRYING OUT THE INVENTION

Experimental alloys were prepared by induction melting in 25mm outside diameter, dense alumina crucibles using a 15 kilowatt furnace. A charge of about 100 grams of high purity alloying elements were used. The surfaces of the charge material, prior to placement in the crucible, were ground with 400 grit silicon carbide paper, and then washed in methanol using an ultrasonic cleaner. About 2 weight percent excess aluminum was added to each charge to compensate for evaporative losses during melting. The furnace was evacuated to $10^{-3}$ Pa and backfilled with high purity argon for three times prior to melting. The molten alloy was allowed to furnace cool in the alumina crucible. Castings produced by this technique were shiny with no evidence of any surface oxide, but had a small degree of shrinkage porosity and cracks that developed during cooling. Most of the alloys had very low amounts (less than 100 ppm) of interstitial elements such as oxygen and nitrogen. Complex alloys containing four to five elements exhibited some segregation, particularly at the bottom and top ends of the ingot which were rejected during machining. Chemical analyses were carried out using an ICP emission spectrometer.

Oxidation experiments were carried out using rectangular coupons $1.2\times0.5\times0.25$ cm, each having a 0.20 cm diameter hole for hanging in the isothermal and cyclic oxidation furnaces. The coupons were prepared from the as-cast ingots by electric discharge machining. The coupons were polished using 600 and 1200 grit silicon carbide papers, cleaned in detergent and then ultrasonically cleaned in alcohol prior to oxidation testing. Isothermal oxidation tests on all experimental alloys were carried out at 1200° C. for 50 hours in oxygen using a continuously recording Cahn 1000 microbalance. Some selected alloys were tested in the temperature range 1000°–1400° C. for up to 100 hours. The steady state kinetic data obtained from the isothermal tests were retrofitted by a linear regression technique to a parabolic model of oxidation.

Cyclic oxidation tests were carried out on some selected alloys at 1200° C. in air for 100 cycles. Each cycle consisted of a one hour hold at 1200°C. followed by a 20 minute cool down outside the furnace. Specific weight changes were determined at regular intervals of 15 cycles.

After both types of oxidation tests, the retained oxides on the specimen surfaces and any collected spall were analyzed by x-ray diffraction to determine the oxide phases present. Detailed investigations of the oxide scale and metal were carried out on selected specimens using optical, electron microscopic and electron microprobe techniques.

EXAMPLE 1

Figure 1:
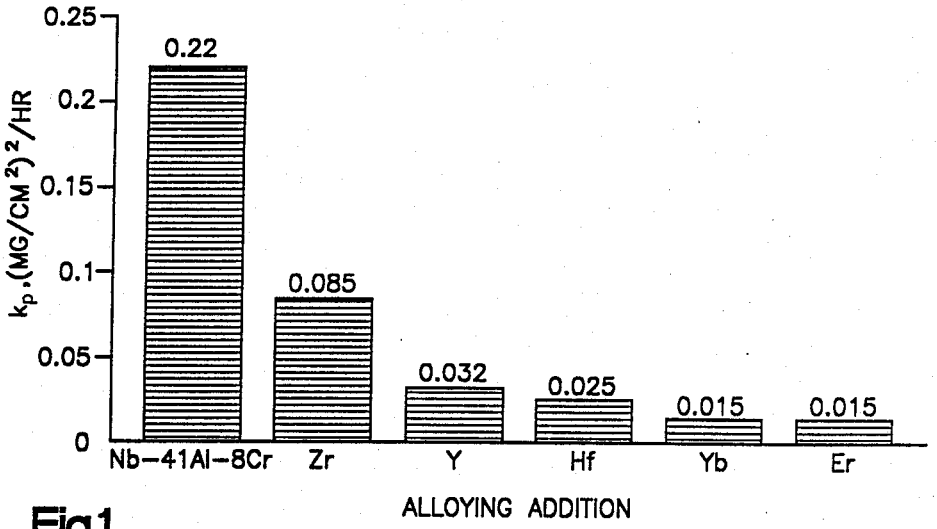
FIG. 1 is a graph showing the effects of a 1% addition of various oxygen active elements on the isothermal oxidation behavior of a 51% niobium, 41% aluminum and 8% chromium base alloy at 1200° C. in an oxygen atmosphere.

51% niobium, 40% aluminum and 8% chromium base alloys containing 1% additions of zirconium, yttrium hafnium, ytterbium and erbium were prepared in the manner described above. FIG. 1 shows the influence of the 1% additions of the oxygen active elements on the isothermal oxidation behavior of the alloys at 1200° C. in an oxygen atmosphere. It will be seen from FIG. 1 that yttrium, ytterbium and erbium resulted in parabolic oxidation rates ranging from 0.015–0.032.

EXAMPLE 2

Figure 2:
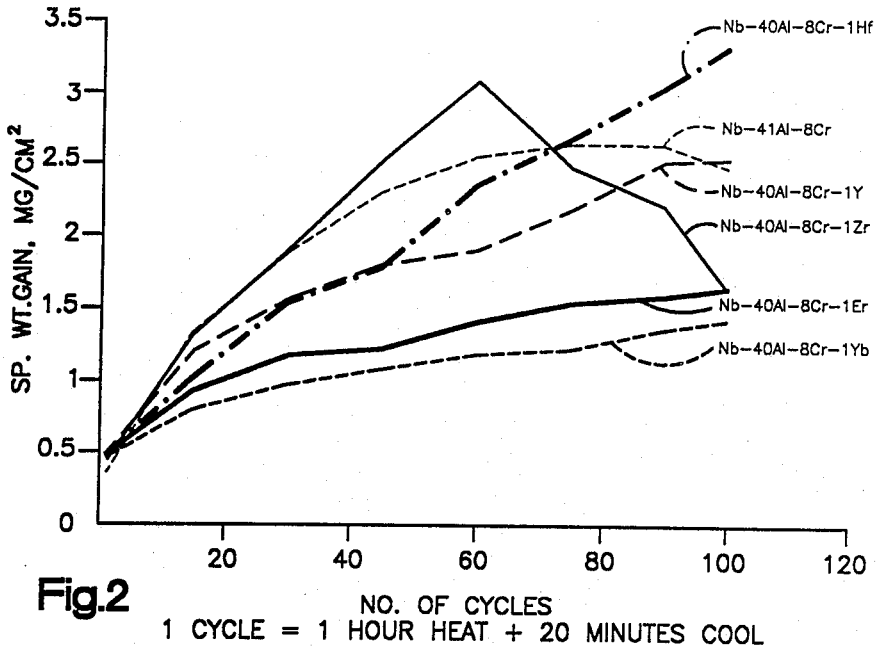
FIG. 2 is a plot showing the influence of the oxygen active elements of FIG. 1 on the cyclic oxidation behavior at 1200° C. in air.

The same alloys used in Example 1 were subjected to cyclic oxidation tests carried out in the manner previously described. FIG. 2 shows the influence of the oxygen active elemental additions on the cyclic oxidation behavior of the alloys at 1200° C. in air. The additions of yttrium, ytterbium and erbium resulted in the lowest specific weight gains. A higher specific weight gain resulted from the hafnium addition, and spalling occurred with the zirconium modified alloy.

EXAMPLE 3

Figure 3:
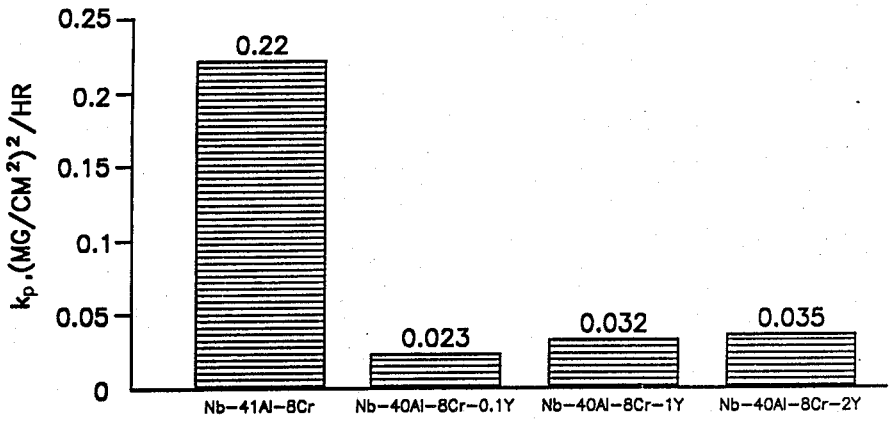
FIG. 3 is a graph showing the effect of yttrium on the oxidation rates of a niobium, 40% aluminum, 8% chromium alloy.

Niobium, 40% aluminum, 8% chromium base alloys were prepared with yttrium additions of 0.1%, 1.0% and 2.0%. The parabolic oxidation rates were compared to a 51% niobium, 41% aluminum, 8% chromium alloy, and the results are shown in FIG. 3. The 0.1% yttrium addition alloy had a low parabolic oxidation rate of 0.023, while the 2.0% yttrium addition alloy had an oxidation rate of 0.035. It will be seen from FIG. 3 that the 0.035 oxidation rate for the 2.0% yttrium addition alloy was slightly higher than a 0.032 oxidation rate for the 1.0% yttrium addition alloy. Based on this study, the upper limit of the yttrium addition range is given at 2.0%, but addition amounts in excess of 1.0% or 1.5% are not seen to produce desirable improvements are considered uneconomic.

EXAMPLE 4

Figure 4:
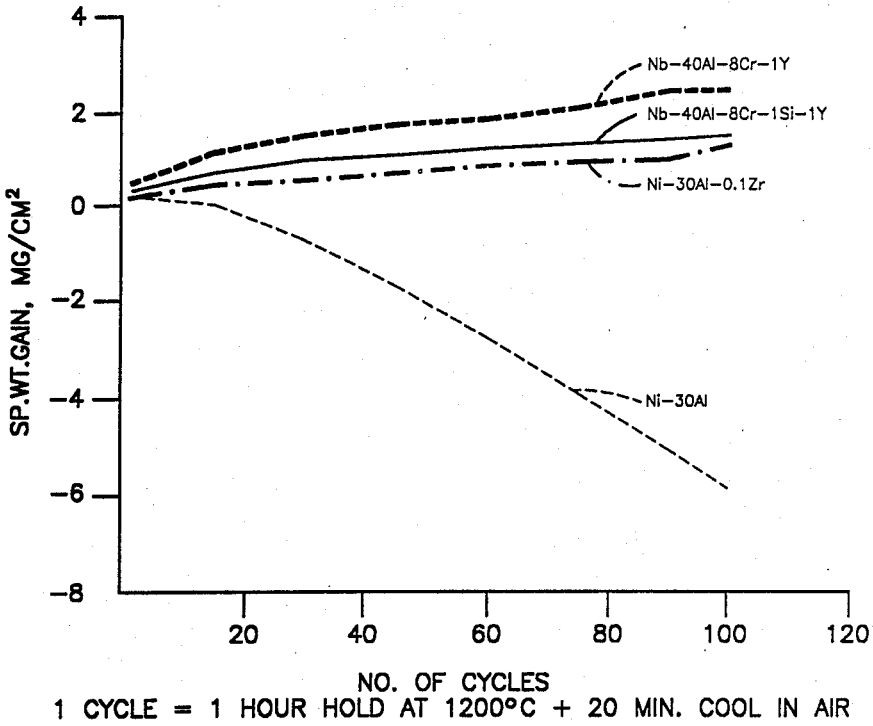
FIG. 4 is a plot showing cyclic oxidation data of two different niobium-aluminum-chromium-yttrium alloys compared to a nickel, 30% aluminum alloy and nickel, 30% aluminum, 0.1% zirconium alloy.

Niobium, 40% aluminum, 8% chromium base alloys were prepared, one having a 1% yttrium addition and another having a 1% silicon and a 1% yttrium addition. The cyclic oxidation behavior of the two alloys was compared to that of a nickel, 30% aluminum alloy and a nickel, 30% aluminum, 0.1% zircon alloy. It will be seen from FIG. 4 that the cyclic oxidation behavior of the niobium base alloys of the invention compared favorably to the nickel-aluminum-zirconium alloy. The loss of specific weight by the nickel-aluminum alloy indicates severe spalling.

EXAMPLE 5

Figure 5:
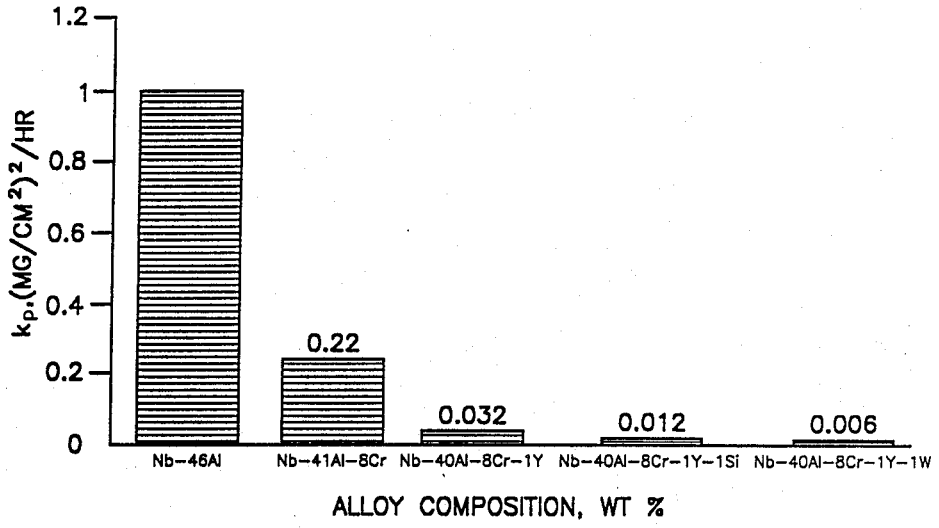
FIG. 5 is a graph showing the influence of various alloying additions on isothermal oxidation rates of $NbAl_3$ at 1200° C. in oxygen.

Niobium, 40% aluminum, 8% chromium base alloys were prepared with additions of 1% yttrium, 1% yttrium with 1% silicon, and 1% yttrium with 1% tungsten. FIG. 5 shows the influence of these alloying additions on the isothermal oxidation rates at 1200° C. in oxygen in comparison with a niobium, 46% aluminum alloy and a niobium, 41% aluminum, 8% chromium alloy. The three alloys of the invention had low parabolic oxidation rates ranging from 0.006 for the tungsten and yttrium addition to 0.032 for the yttrium addition alloy. It will be seen that the substitution of 1% tungsten for 1% silicon resulted in a reduction of the parabolic oxidation rate from 0.012 to 0.006.

EXAMPLE 6

Figure 6:
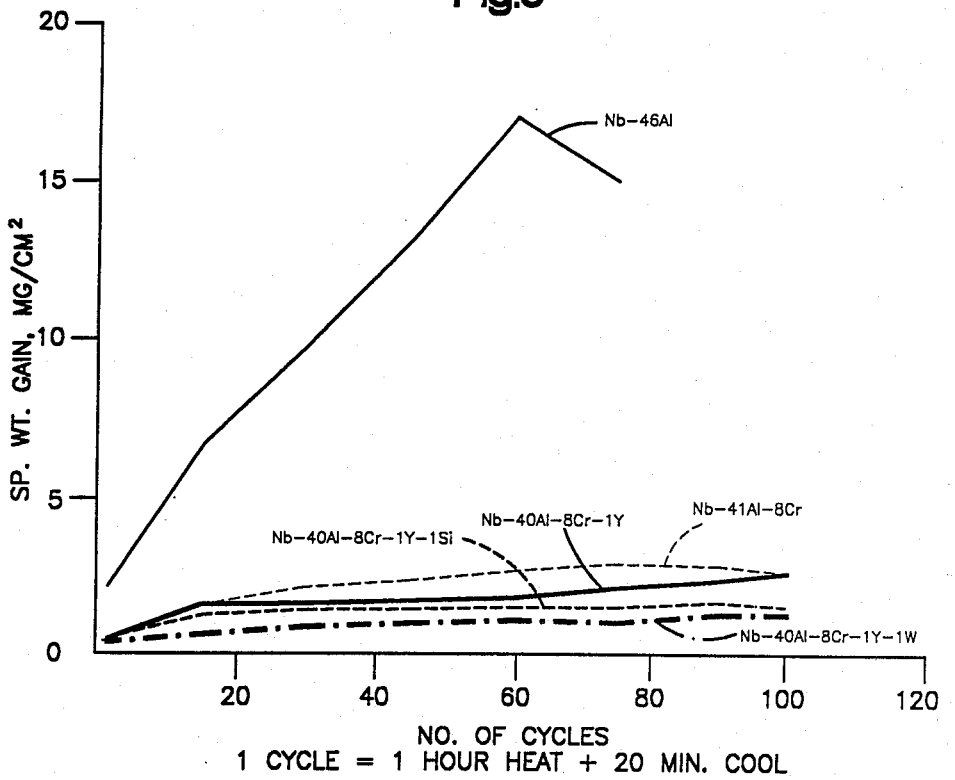
FIG. 6 is a plot showing the influence of the alloying additions of FIG. 5 on the cyclic oxidation behavior at 1200° C. in air.

The alloys of Example 5 were subjected to cyclic oxidation tests and the results are plotted in FIG. 6. The three alloys of the invention (yttrium addition, yttrium plus silicon addition, and yttrium plus tungsten addition) had the lowest specific weight gains, while the 54% niobium-46% aluminum alloy had the highest specific weight gain.

EXAMPLE 7

Figure 7:
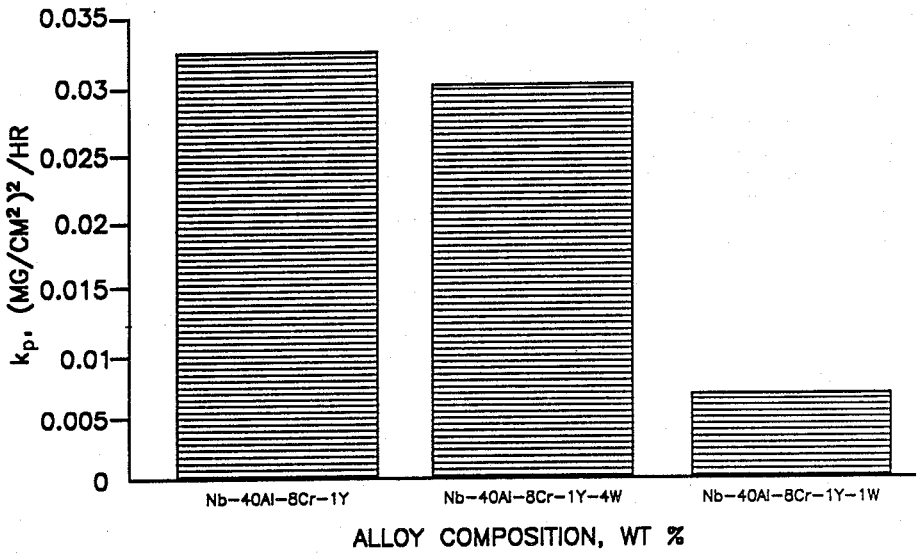
FIG. 7 is a graph showing the influence of tungsten on isothermal oxidation rates of niobium, 40% aluminum, 8% chromium, 1% yttrium alloys at 1200° C. in oxygen.

Three niobium, 40% aluminum, 8% chromium base alloys were prepared, one with a 1% yttrium addition, a second with a 1% yttrium and 4% tungsten addition, and a third with a 1% yttrium and a 1% tungsten addition. The influence of the tungsten additions on isothermal oxidation rates in comparison to the yttrium addition alloy is shown by FIG. 7. The 4% tungsten addition resulted in a slightly lower oxidation rate than achieved by a 1% yttrium addition alone. The alloy having a 1% yttrium with a 1% tungsten addition had a significantly lower oxidation rate.

It will be seen that the invention achieves its objective of providing a new niobium-aluminum base alloy having excellent high temperature oxidation resistance. The parabolic oxidation rates, $k_p$, at 1200° C. range from about 0.006 to about 0.032 $(mg/cm^2)^2/hr$. These are believed to be the lowest values of $k_p$ recorded to date on any niobium aluminide and are comparable to the best NiAl plus Zr alloys. The alloys of the invention will also be seen to exhibit excellent cyclic oxidation resistance for 100 hours at 1200° C., being nearly equivalent to nickel aluminum plus zirconium. The oxide-metal interface examined by electron microprobe have shown continuous and compact protective alumina scales and no evidence of any internal oxidation. Based on this excellent oxidation behavior, the alloy of the invention offers significant potential in advanced aerospace applications, including matrices for fiber reinforced composites for turbine blades and as a coating for niobium in rocket nozzles.

Many changes and modifications of the invention will be apparent to those skilled in the art in light of the foregoing detailed disclosure. Therefore, within the scope of the appended claims, it is to be understood that the invention can be practiced otherwise than as specifically shown and described.

We claim:

1. An oxidation resistant, niobium-aluminum base alloy consisting essentially in amounts by weight of about 48–52% niobium, 36–42% aluminum, 4–10% chromium, 0–2% silicon and/or tungsten, 0.1–2.0% of a rare earth selected from the group consisting of yttrium, ytterbium and erbium.

2. The alloy according to claim 1 containing about 1–2% silicon and/or tungsten.

3. The alloy according to claim 2 wherein tungsten is present in the absence of silicon.

4. An oxidation resistant, niobium-aluminum base alloy consisting essentially in amounts by weight of about 50% niobium, 40% aluminum, 8% chromium, 1% of a rare earth selected from the group consisting of yttrium, ytterbium and erbium, and 1–2% tungsten and/or silicon.

5. The alloy according to claim 4 wherein tungsten is present in the absence of silicon.

* * * * *